United States Patent [19]

Casey

[11] Patent Number: 4,631,765

[45] Date of Patent: Dec. 30, 1986

[54] MODULAR COVERING AND A METHOD OF ASSEMBLING THE SAME

[76] Inventor: Susan D. Casey, 243 W. 72nd St. #7, New York, N.Y. 10023

[21] Appl. No.: 732,964

[22] Filed: May 13, 1985

[51] Int. Cl.[4] ..... A47G 9/06

[52] U.S. Cl. ..... 5/417; 5/420; 5/465; 5/502

[58] Field of Search ..... 5/417–420, 5/437, 442, 482, 485, 465, 500, 502; 2/DIG. 2, 275

[56] References Cited

U.S. PATENT DOCUMENTS

| | | | |
|---|---|---|---|
| 356,624 | 1/1887 | Curtis | 2/275 |
| 774,996 | 11/1904 | Starkweather | 5/442 |
| 1,267,042 | 5/1918 | Arnold . | |
| 1,574,405 | 2/1926 | Moulton | 2/275 |
| 1,668,373 | 5/1928 | Krasity | 5/465 |
| 2,174,831 | 10/1939 | Müller | 2/275 |
| 2,660,735 | 12/1953 | Baum | 5/500 |
| 2,730,728 | 1/1956 | Roberts . | |
| 2,808,596 | 10/1957 | Schreiner . | |
| 3,154,798 | 11/1964 | Harris et al. . | |
| 3,273,176 | 9/1966 | Millar . | |
| 3,530,516 | 9/1970 | Marquette . | |
| 3,863,387 | 2/1975 | Webster et al. | 5/420 |
| 4,005,499 | 2/1977 | Klein . | |
| 4,242,767 | 11/1981 | McMullan et al. | 5/465 |
| 4,459,714 | 7/1984 | Lin | 5/465 |

FOREIGN PATENT DOCUMENTS

| | | | |
|---|---|---|---|
| 516218 | 6/1953 | Belgium | 5/417 |

*Primary Examiner*—Gary L. Smith
*Assistant Examiner*—Michael F. Trettel
*Attorney, Agent, or Firm*—Marshall & Melhorn

[57] ABSTRACT

A covering module is formed of a pair of sheets of flexible material superposed and connected along adjacent marginal edges, leaving at least one opening, and a strip of flexible material is connected to the marginal edges of one of the sheets with the sheets being turned inside out. Stuffing material is then inserted through the opening into the interior of the module, and connection of the sheets and strip at a location interior of the marginal edges thereby closes the opening. Fasteners are attached to the marginal edges to permit detachable connection of the modules to form quilts, sleeping bags, window, wall ceiling or floor coverings, and the like.

15 Claims, 7 Drawing Figures

MODULAR COVERING AND A METHOD OF ASSEMBLING THE SAME

BACKGROUND OF THE INVENTION

1. Field of the Invention

The invention generally concerns covers and in particular, modules which are adapted to be detachably connected to one another to form such structures as bed covers, cushions, window covers, ceiling and floor covers, or sleeping bags, for example.

2. Description of the Prior Art

Many forms of quilts or covers are shown in the prior art which are comprised of sections detachably connected to one another. For example, U.S. Pat. No. 1,267,042 discloses an insulated quilt structure including two longitudinal panels detachably connected to each other with flaps to overlap the area where the panels are connected. The detachable panels facilitate handling during laundering and mending. Alternate means of fastening the panels together include a ball and socket connection, buttons and holes, and hooks and loops.

U.S. Pat. No. 4,005,499 discloses a bed cover, such as a blanket or sheet, which includes two partially overlapping panels, longitudinally arranged in relation to the structure and detachably connected to one another by means of fabric ties on the overlapping edges of the panels. The panels may be individualized to suit the occupant of the bed from the standpoint of the color and texture of the fabric of which the panel is made and by insertion of a scented or medicated sachet in a pocket structure incorporated in each panel.

U.S. Pat. No. 3,530,516 discloses a blanket having two longitudinally arranged panels which are detachably connected by a slide-type fastener on the connecting edges of the panels. The panels may be individualized to suit the occupant of the bed by selecting the thickness or insulative quality of the blanket material of which each panel is made.

U.S. Pat. No. 3,273,176 discloses a blanket possessing a detachable and replaceable sanitary panel extending transversely at the head of the blanket. Numerous means for detachable connection of the panel to the blanket body are disclosed including zippers and snap fasteners, for example.

U.S. Pat. No. 2,808,596 discloses a mattress cover formed with openings to foster ventilation and circulation of air therethrough. The mattress cover is formed of a pair of transversely extending end panels detachably connected to an intermediate panel by means of a cord laced through eyes on the connecting portions of the panels. When worn out, a panel may be removed and a new one attached, thereby extending the life of the overall assembly.

SUMMARY OF THE INVENTION

The present invention concerns covering modules adapted to be detachably connected to one another to form blankets, quilts, window covers, and the like. Each module is pillow-like and of a regular geometric shape. The modules are constructed from a pair of flexible sheets superposed and connected along their marginal edges leaving an opening typically at a corner. A strip of flexible material is connected adjacent the marginal edges of one of the sheets and the assembly is turned inside out through the opening. The assembly is then stuffed and the opening closed. Affixed along the marginal edge at regular, predetermined intervals, are fasteners of a type suitable for detachably connecting the modules together.

It is an object of this invention to provide quilt modules adapted to be detachably connected to one another to form coverings of various shapes, designs and configurations.

It is another object of this invention to provide quilt modules detachably connected to each other to be assembled in various ways to alter the pattern of color or texture of a shape, design or configuration.

The modules may be used, for example, individually as seat cushions, or pillows, or assembled to form various structures, such as, quilts, sleeping bags, ground pads and insulative window and wall covers to protect against sound and temperature changes.

When modules possessing covers of differing colors or textures are used, they may be assembled and reassembled to vary the pattern possessed by a structure. Furthermore, modules having covers of a different color or texture on each side may be inverted and attached, thereby increasing the variety of patterns of color and texture possible in an assembled structure.

BRIEF DESCRIPTION OF THE DRAWINGS

The various features, advantages and other uses of this invention will become more apparent by referring to the following detailed description and drawings in which.

DESCRIPTION OF THE PREFERRED EMBODIMENT

Figure 1:
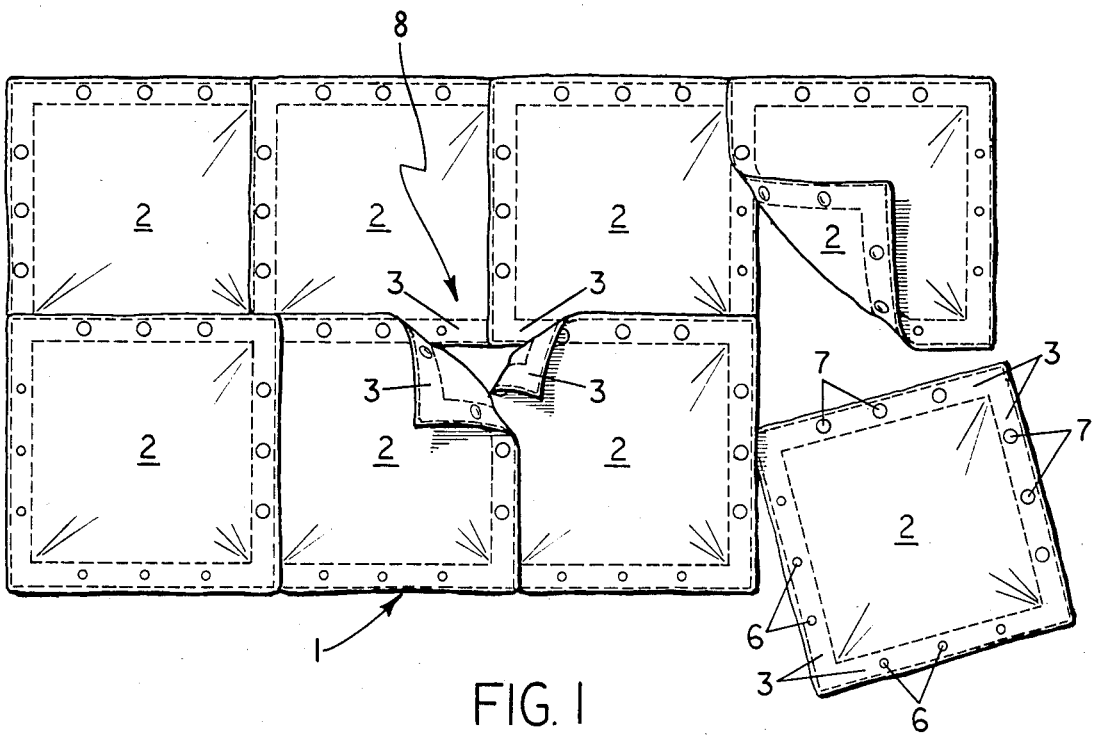
FIG. 1 is a plan view of a plurality of modules according to the present invention connected to form a bed covering.
Figure 2:
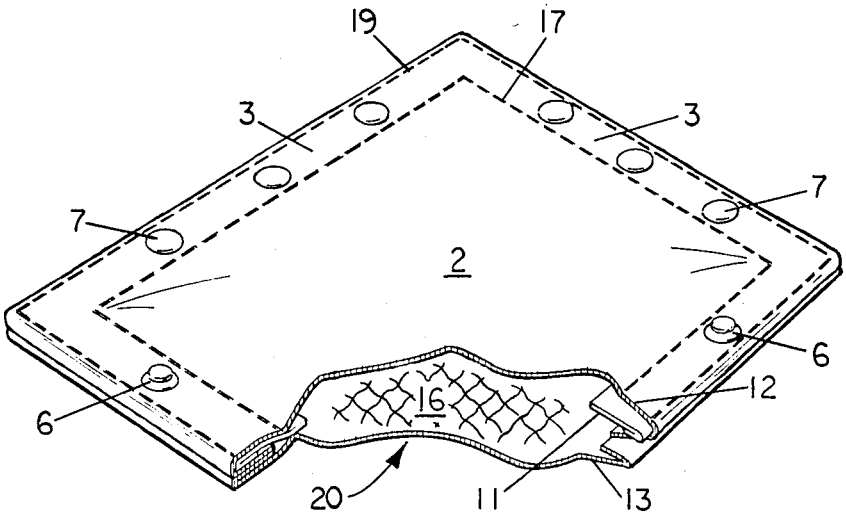
FIG. 2 is a cut-away perspective view showing details of construction of one of the modules of FIG. 1.

Referring now to FIGS. 1 and 2, a module 2 is generally square in shape and measures approximately eighteen to twenty-one inches along each side. However, the shape and size can vary according to preference and intended use. Affixed at predetermined, spaced-apart locations on each of the marginal edges 3 of the module are a plurality of snap fasteners such as fasteners 6 and 7. The snap fasteners are arranged so that fasteners of the male type 6 are attached to two adjacent marginal edges and fasteners of the female type 7 are attached to the remaining two adjacent marginal edges of the module.

Snap fasteners 6 and 7 are representative of a myriad of other fasteners providing detachable connection, such as, buttons and holes, Velcro brand molded and fabric hook and loop fasteners, (commercially available from Velcro USA, Inc., 406 Brown Ave., P.O. Box 5218, Manchester, N.H. 03108), and cord laced through eyes, for example. Each fastener has its advantages and disadvantages as would be apparent to those skilled in the art. The key to employing any fastening device is to arrange the fasteners to optimize variations in assembly of the modules.

When connected together to form a quilt 1, as shown in FIG. 1 for example, the marginal edges 3 of the modules will overlap and interleave as at 8 to provide the finished assembly with a pleasing appearance and reduce the passage of air between the modules. More closely spaced fasteners or a continuous fastener will tend also to reduce air flow and increase the insulating properties.

Figure 3:
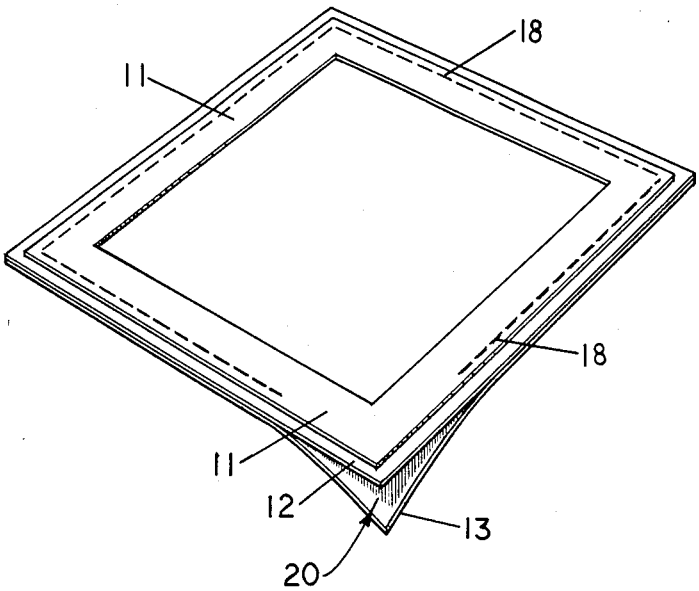
FIG. 3 is a perspective view of a module according to the present invention during the initial steps of construction.
Figure 4:
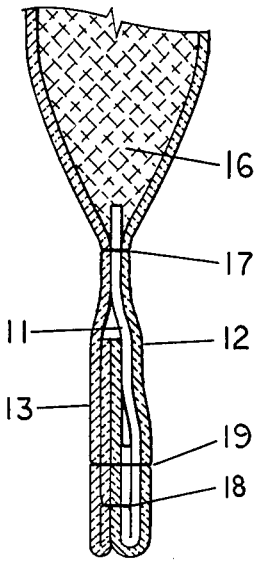
FIG. 4 is an enlarged partial cross-sectional view of a marginal edge of a module according to the present invention.

As shown in FIG. 3, each module 2 is constructed from a pair of covers 12 and 13 which are placed face-to-face and a strip of interfacing 11, such as Pellon (commercially available from Pellon Corporation, Industrial Products Division, Chelmsford, Me. 01824), which is applied on top of the edges of the uppermost cover 12. The components of the module are bound together by a row of stitching 18, passing through the covers 12 and 13 and interfacing 11, and extending around the module, but leaving an unbound area to serve as an opening 20 to the interior of the module. The module is turned right-side-out through the opening 20, as shown in FIG. 2, and bound about the marginal edges a second time by stitching 17 applied a predetermined distance from the edge of the module, but leaving the opening 20 unbound. FIG. 4 is an enlarged partial cross-sectional view taken through a marginal edge of the module to show the resulting construction. The stitching 17 defines a pillow-like body and prevents stuffing from filling the marginal edges 3. A third line of stitching 19 can be used to prevent separation of the sheets 12 and 13 at the edges. Although shown between stitching 17 and 18, the stitching 19 could be located between stitching 18 and the outer edge of the module. Other forms of attaching the two sheets can be utilized such as stapling or thermally bonded material.

Stuffing 16 suitable for padding or insulation may be introduced through the opening 20 to fill the module. The opening is then bound together and fastening devices 6 and 7 added.

Figure 5:
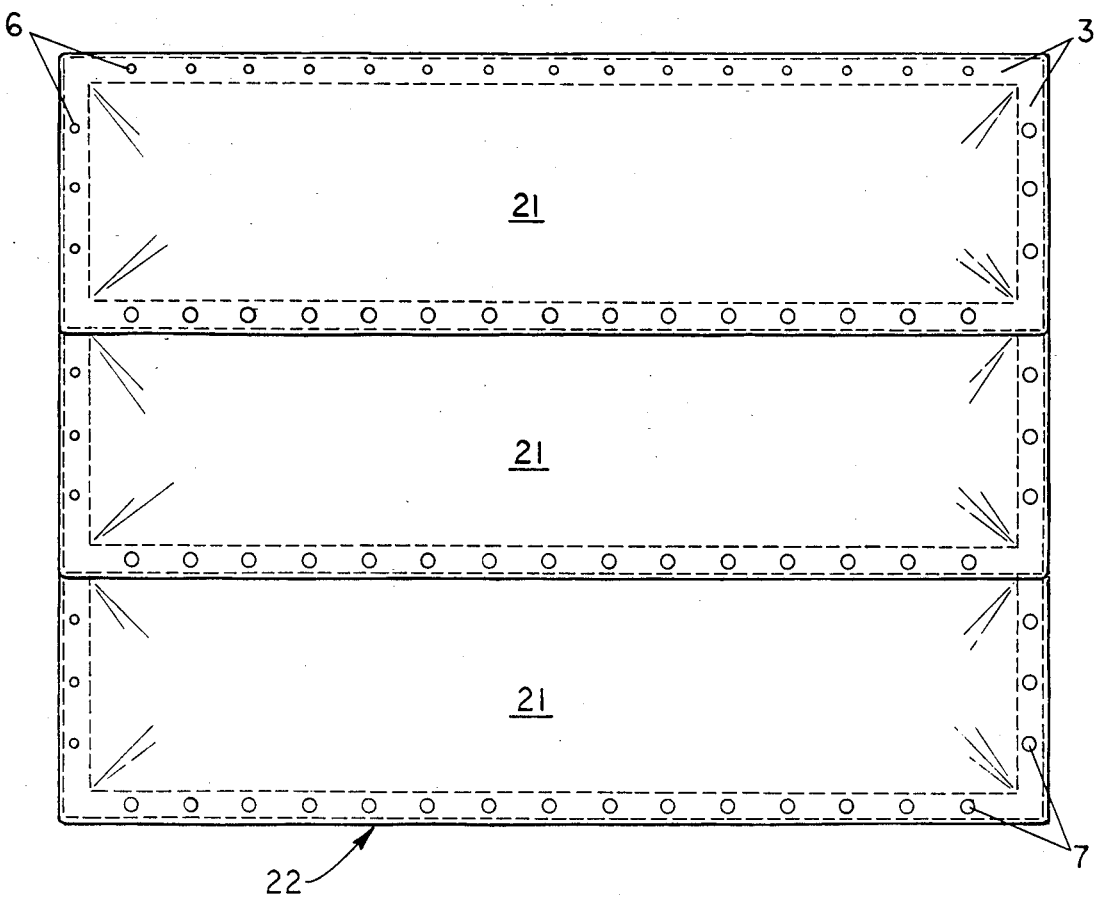
FIG. 5 is a plan view of a second embodiment of the modules assembled as a quilt.

Other embodiments of the invention include rectangular, or tube-shaped modules 21 shown in FIG. 5, of a construction similar to the modules of the preferred embodiment, sized to extend longitudinally substantially the full length of a bed or transversely, the width of a bed. Tube-shaped modules may be detachably connected together by a plurality of male fasteners 6 and female fasteners 7 or other fastening devices affixed on the marginal edges of the modules so that fasteners of solely male type 6 are affixed on any one marginal edge of the module and fasteners solely of the female type 7 are affixed to the opposite marginal edge. When assembled, tube-shaped modules can form structures like a quilt 22.

Figure 6:
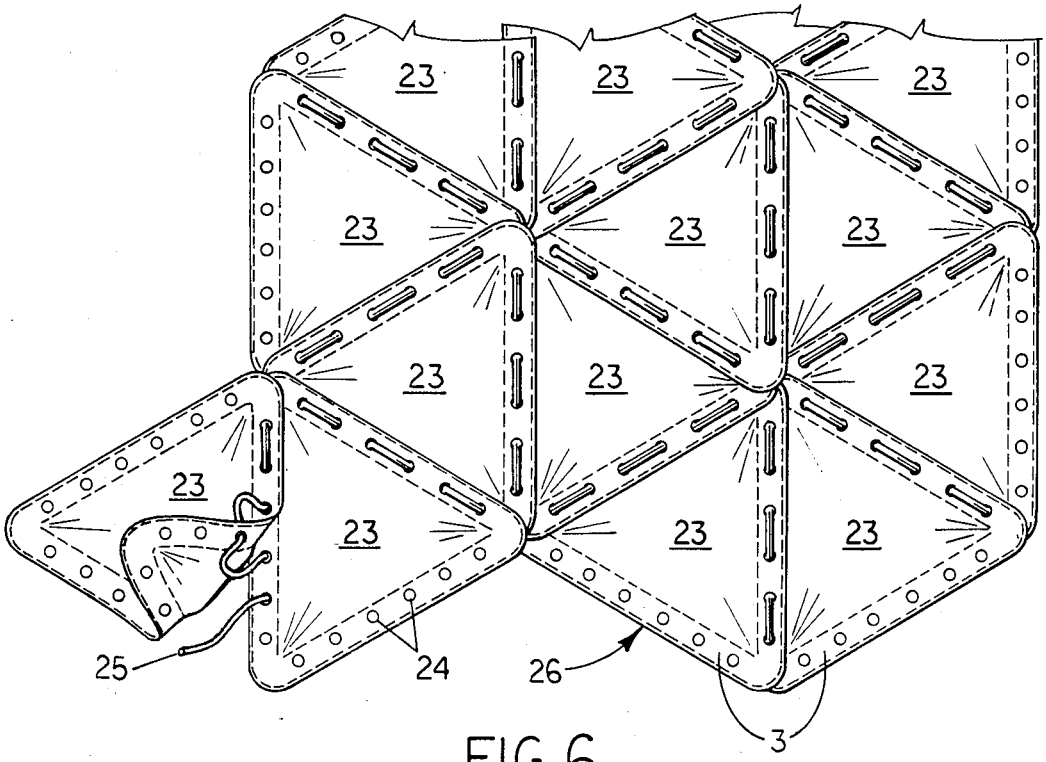
FIG. 6 is a plan view of a third embodiment of the modules assembled as a quilt.

Triangular modules 23, as shown in FIG. 6, are constructed in a manner similar to the modules of the preferred embodiment. However, in place of snap fasteners, the modules are detachably connected by means of grommeted eyes 24 attached at predetermined, spaced-apart locations about the marginal edges of the modules. The eyes 24 are adapted to receive a cord 25 laced through the eyes 23 and secured or tied-off to hold the modules in their assembled configuration. When assembled, triangular modules may form structures like a quilt 26.

Figure 7:
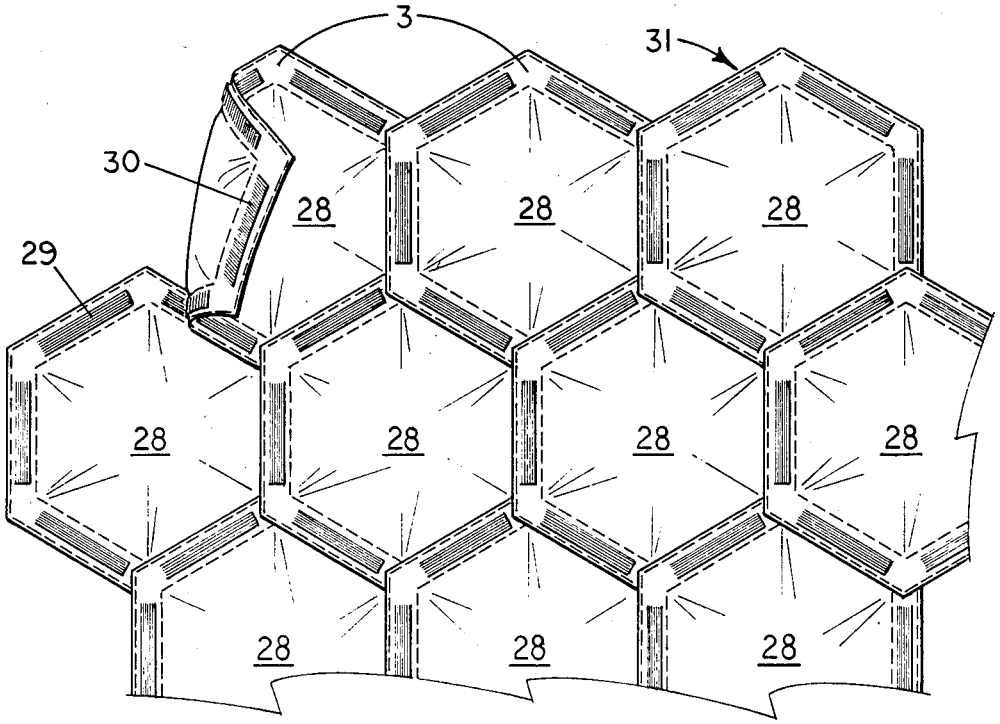
FIG. 7 is a plan view of a fourth embodiment of the modules assembled as a quilt.

Hexagonal modules 28, as shown in FIG. 7, are constructed in a manner similar to the modules of the preferred embodiment. However, in place of snap fasteners, or cords and eyes, the modules are detachably connected together by means of Velcro strips 29 and 30 affixed at predetermined locations on the marginal edges 3 of the modules. The Velcro strips may be affixed as indicated with the hook-type part 30 solely on one side of the module, and the loop-type part 29 solely on the other side of the module. When assembled, hexagonal modules may form structures like a quilt 31.

In accordance with the provisions of the patent statutes, the principle and mode of operation of the present invention have been explained and illustrated in its preferred embodiment. However, it must be appreciated that the present invention can be practiced otherwise than as specifically explained and illustrated without departing from its spirit or scope.

What is claimed is:

1. A covering module comprising:

a pair of similarly shaped sheets of flexible material connected together in face-to-face relationship at a first location along adjacent marginal edges to form a pillow-like body, a strip of flexible material having an outer marginal edge connected in face-to-face relationship to at least one of said sheets adjacent said marginal edges thereof, said marginal edges and said outer marginal edge of said strip being folded back between said sheets toward a center of said body, said folded back marginal edges of said sheets and said folded back outer marginal edge of said strip being connected together in face-to-face relationship to said sheets at a second location closer to said center of said body than said first location, said sheets and said strip being connected together in face-to-face relationship at a third location closer to said center of said body than said second location.

2. The covering module defined in claim 1 wherein said body is generally square in plan view.

3. The covering module defined in claim 1 wherein said body is generally rectangular in plan view.

4. The covering module defined in claim 1 wherein said body is generally triangular in plan view.

5. The covering module defined in claim 1 wherein said body is generally hexagonal in plan view.

6. The covering module defined in claim 1 including a plurality of fasteners attached adjacent said marginal edges of said sheets for detachably connecting at least two of the bed covering modules together.

7. The covering module defined in claim 6 having dimensions in plan view whereby a plurality of the modules can be detachably connected to form a quilt of standard size.

8. The covering module defined in claim 6 wherein said fasteners include grommets in said marginal edges and ties for threading through said grommets.

9. The covering module defined in claim 6 wherein said fasteners include a plurality of male-type fasteners attached along one of said marginal edges and a plurality of female fasteners attached along another of said marginal edges.

10. The covering module defined in claim 9 wherein said male-type and female-type fasteners are snap fasteners.

11. The covering module defined in claim 9 wherein said male-type and female-type fasteners are hook and loop fasteners.

12. The covering module defined in claim 1 including stuffing positioned between said sheets in said center of said body, said third location being adjacent said stuffing to retain said stuffing in said center of said body.

13. The covering module defined in claim 1 wherein said connections at said first, second and third locations are formed as stitches.

14. The covering module defined in claim 1 wherein said connection at said second location is formed as stitches which are exposed.

15. A covering module comprising:

a pair of similarly shaped sheets of flexible material stitched together in face-to-face relationship at a first location along adjacent marginal edges to form a pillow-like body, a strip of flexible material having an outer marginal edge stitched in face-to-face relationship to at least one of said sheets at said first location, said marginal edges and said outer marginal edge of said strip being folded back between said sheets toward a center of said body, said folded back marginal edges of said sheets and said folded back outer marginal edge of said strip being stitched together in face-to-face relationship to said sheets at a second location closer to said center of said body than said first location, said stitching at said second location being exposed, stuffing positioned between said sheets in said center of said body, said sheets and said strip being stitched together in face-to-face relationship at a third location closer to said center of said body than said second location and adjacent said stuffing to retain said stuffing in said center of said body.

* * * * *